United States Patent [19]

Brill

[11] 4,404,826

[45] Sep. 20, 1983

[54] KEEPER DEVICE FOR DOOR LOCK

[76] Inventor: Garrett W. Brill, 745 NE. 88 St., Miami, Fla. 33138

[21] Appl. No.: 269,839

[22] Filed: Jun. 3, 1981

[51] Int. Cl.[3] ..... E05B 13/00

[52] U.S. Cl. ..... 70/416; 70/431

[58] Field of Search ..... 70/211, 416, 418, 419, 70/429, 430, 431, 447; 292/347

[56] References Cited

U.S. PATENT DOCUMENTS

| | | | |
|---|---|---|---|
| 2,463,195 | 3/1949 | Mungan | 70/416 |
| 3,423,974 | 1/1969 | Bernsley | 70/416 |
| 3,826,117 | 7/1974 | Racobs | 70/416 |

FOREIGN PATENT DOCUMENTS

| | | | |
|---|---|---|---|
| 665769 | 1/1952 | United Kingdom | 70/416 |

*Primary Examiner*—Robert L. Wolfe

*Attorney, Agent, or Firm*—John Cyril Malloy

[57] ABSTRACT

A keeper device for a door lock which is composed of a channel form member having a web right angularly bent from the main web plane and a pair of flanges extending oppositely from the web and wherein an opening is provided in the reversely bent web portion to receive the bolt therethrough and wherein a block is provided which is sized to be received between the flanges of the channel and which is provided with a rectangular opening sized to receive an elliptical operator knob of the lock, so that when installed, the lock may not be opened from the outside or the inside unless the block is removed, and preferably, magnets are provided to keep the block in keeper relationship with the channel web.

2 Claims, 3 Drawing Figures

KEEPER DEVICE FOR DOOR LOCK

BACKGROUND OF THE INVENTION

In the past there have been numerous types of devices to guard against opening of a door by a thief. This invention is of such a device.

On many doors there are bolts which are operated by turning an operator on the lock inside the home or, from the outside, by a key. This invention is for use with such locks. It is composed of a keeper having a channel form member with a web extending from the channels and the web of which is folded back away from the channel flanges so that a hole through it is adapted to receive the lock bolt and wherein a block may be positioned between the flanges with an opening in it which will restrain rotation of the operator, which is usually elliptical, as shown in the drawings.

OBJECTS OF THIS INVENTION

It is an object of this invention to provide a device to be installed on doors from the inside so that the lock cannot be opened without removal of the device and which is simple and inexpensive to install, is portable, and may be utilized on a wide variety of doors. A wide range of door sizes and lock devices may be accommodated by reason of the structure described.

In accordance with these and other objects which will become apparent hereinafter, the instant invention will now be described with reference to the accompanying drawings in which:

DESCRIPTION OF THE DRAWINGS

FIG. 3 is a rear elevation view of a block forming a portion of te invention.

DESCRIPTION OF THE PREFERRED EMBODIMENT

Figure 1:
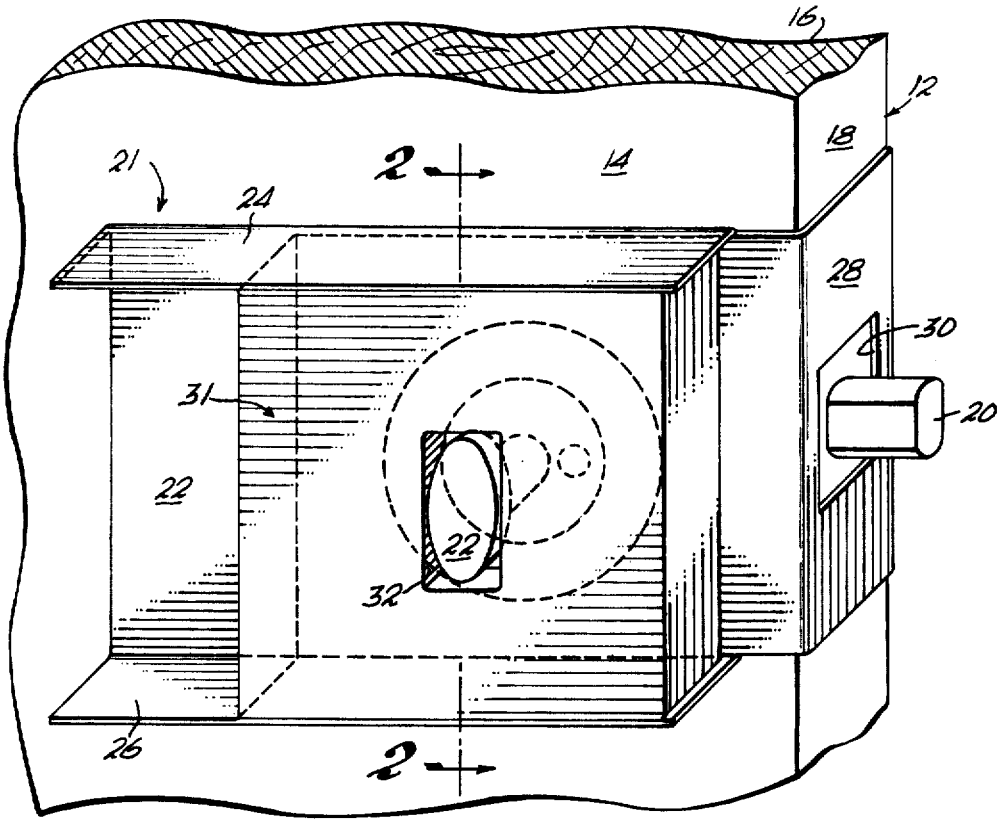
FIG. 1 is a perspective view of the instant invention installed on a door.
Figure 2:
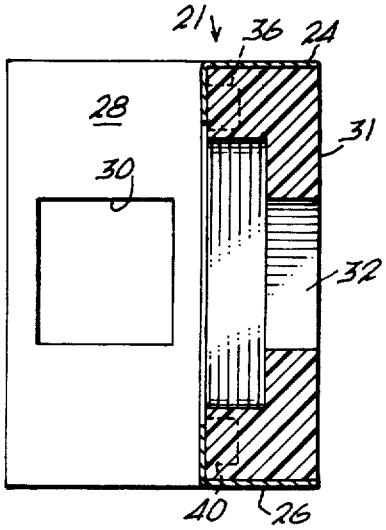
Figure 3:
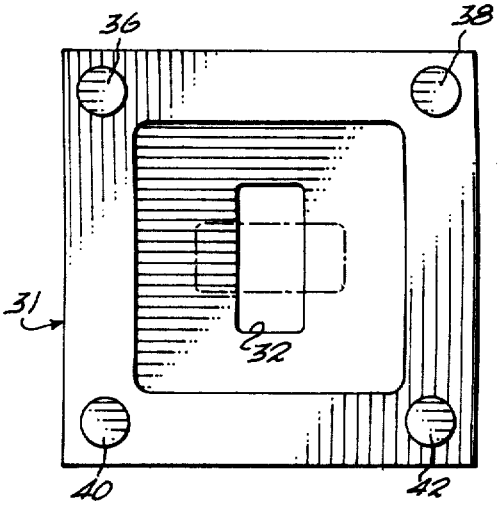
FIG. 3 is a view taken on the plane indicated by the line 2—2 and looking in the direction of the arrows.

A door generally designated by the numeral 12, as is conventional, has an inside face 14 and an outside face 16 as well as a swingable side 18. From the side a lock bolt 20 is movable upon manipulating an operator 22 on the inside surface or a key on the outside surface, the latter not being shown. In other words, the bolt 20 can be advanced or withdrawn simply by turning the knob 22 on the inside. This device is of a unit which can be installed to prohibit that oblong or elliptical operator knob from being turned and hence the door from being unlocked from outside. The unit generally designated by the numeral 21 is composed of a channel form member having a web 22 and an upper flange and lower flange 24 and 26. The web is reversely bent as at 28 and provided with a cutout 30 that accommodates passage of the bolt. In use, once installed, as shown in FIG. 1, a block, as designated by the numeral 31, is inserted between the two flanges 24 and 26 with an opening 32 in it accommodating the operator 22, it can be seen that the operator cannot be turned because of the block acting in cooperation with the flanges. The block is preferably provided with magnets 36, 38, 40, 42 to hold it in position. It is thus seen that there is provided and disclosed a device which is simple and easily installed in the inside of a home or the like which will prohibit the lock from being opened from the outside.

What is claimed is:

1. For a door having an outside and an inside main face and gripped with a bolt movable from the door side between the faces into and out of a locked position upon operation of an outside key or an inside operator knob, a keeper comprising a channel form member having an upper flange, a lower flange, and a longitudinally extending web, said longitudinally extending web being bent from the main plane of the web away from the channel members and including a cutout portion sized to accommodate the bolt of the door and a block sized to nest between the flanges and including a cutout to receive the operator and restrain movement of the bolt.

2. The device as set forth in claim 1 wherein the block is proviced with magnet means to secure it releasably to the channel when in position.

* * * * *